United States Patent [19]

Olorenshaw et al.

[11] Patent Number: 4,881,432

[45] Date of Patent: Nov. 21, 1989

[54] LID REMOVING TOOL

[76] Inventors: George M. Olorenshaw, 11810 Stephens Street, Maple Ridge, B.C. V2X 6S3; Al Macedo, P. O. Box 2462, Squamish, B.C. VON 3GO, both of Canada

[21] Appl. No.: 335,486

[22] Filed: Apr. 10, 1989

[51] Int. Cl.[4] ..... B67B 7/00

[52] U.S. Cl. ..... 81/3.36; 81/3.55

[58] Field of Search ..... 81/3.55, 3.07, 3.36, 81/3.37, 3.56

[56] References Cited

U.S. PATENT DOCUMENTS

| | | | |
|---|---|---|---|
| 961,224 | 6/1910 | Fischer | 81/3.36 |
| 1,250,448 | 12/1917 | Green | 81/3.36 |
| 1,728,418 | 9/1929 | Litchfield | 81/3.36 |
| 4,173,909 | 11/1979 | Cleveland et al. | 81/3.36 |

FOREIGN PATENT DOCUMENTS

| | | | |
|---|---|---|---|
| 699731 | 11/1953 | United Kingdom | 81/3.55 |

*Primary Examiner*—Roscoe V. Parker

*Attorney, Agent, or Firm*—Fulwider, Patton, Rieber, Lee & Utecht

[57] ABSTRACT

A tool for opening containers with a lid having an overlapping rim, engages the rim and levers the lid up. The tool avoids having to cut the lid and allows it to be removed without damage. The container has at least one peripheral rib extending around the wall below the lid and the tool comprises a lever arm having a handle at one end and a rim engaging lip at the other end, an anchor pivoted at a pivot position on the lever arm adjacent the rim engaging lip, the anchor having a top member adapted for engagement with the peripheral rib on the container wall, and a bottom stabilizing member adapted to rest against the container wall below the peripheral rib, such that when the tool is engaged with a container, the rim engaging lip positioned under the overlapping rim of the lid, and the top member of the anchor engaging the peripheral rim of the container wall, lever action of the tool raises the lid from the container.

4 Claims, 1 Drawing Sheet

LID REMOVING TOOL

FIELD OF THE INVENTION

The present invention relates to a tool for opening containers or drums. More specifically, the present invention relates to a tool for opening a container having a lid with an overlapping rim, and an integral peripheral rim extending around a container wall below the lid.

DESCRIPTION OF THE PRIOR ART

Many liquids and solids such as paints, lubricants, bulk food products, naming just a few, are packaged in large cylindrical plastic containers which have lids with an overlapping rim that fits over the top of the container. The overlapping rim generally has a snap fit seal arrangement with the top edge of the container which seals the container and prevents the lid coming off should the container be knocked over during handling. These types of containers vary in size from less than one gallon up to drums of fifty gallons or more. The smaller containers have a diameter in the order of twelve to fifteen inches, and the containers themselves have at least one peripheral rib molded around the container wall below the top rim. These ribs serve to add rigidity to the wall of the container and prevent distortion in the container wall during rough handling. Distortion of the container can cause the seal for the lid to break.

The manufacturers of these types of containers currently recommend that the rim of the lid be cut through at several points around the periphery to facilitate removal of the lid by hand. Whereas this method provides access to the container, the task is difficult to perform, and once the integrity of the seal has been broken, it is not possible to reseal the lid on the container, thus a partially filled container does not preserve the contents therein. An alternative method of opening the lid is to pry up the lid by inserting a tool, under the lip of the lid and levering against the container wall. This requires a tool that is suitable, and such a tool is not generally available as screw drivers or the like are generally too small and damage the container or the lid which breaks the integrity of the seal.

For small containers it is possible to pry up the lid, but the necessary tool to do so is never available or is not the right size. Most containers of this type have at least one peripheral reinforcing rib which extends around below the lip of the container and when the lid is in place the difference in height between this rib and the bottom of the lid is in the range of approximately one half to two inches.

SUMMARY OF THE INVENTION

It is an aim of the present invention to provide a tool for removing a lid from a container, the lid having an overlapping rim and the container having at least one integral peripheral rib extending around the container wall below the lid. The tool is able to open most cylindrical containers having a diameter from ten to twenty inches, and having a gap between the bottom of the overlapping rim of the lid and the peripheral rib of the container wall in the order of approximately one half up to two inches. Whereas one tool will cover one range of containers, it will be apparent to those skilled in the art that different sizes of tools may be provided for different sizes of containers. The containers are generally cylindrical, but may have a different cross sectional shape. For example a square, round, oval or other shape of container may be provided, if this is the case then the tool is arranged to have a gripping arrangement to grip underneath the overlapping rim of the lid and is also arranged to fit between the overlapping rim and the peripheral rib even though the rib may be placed some considerable distance below the lid.

It is a further aim of the present invention to provide a tool which is reasonably light weight, may easily be handled by one individual and by moving it around a lid and performing a levering operation at different locations, can easily remove the lid from the container without damaging the lid. When it is required to reseal the container, the lid can be replaced and a few sharp raps around the edge snaps the lid closed. In a preferred embodiment the tool has a spring loaded anchor arrangement which is generally positioned in the same plane as the tool itself making it easier to engage a container with a lid thereon.

The present invention provides a tool for removing a lid from a container, the lid having an overlapping rim, and the container having at least one integral peripheral rib extending around a container wall below the lid, the tool comprising a lever arm having a handle at one end and a rim engaging means at the other end, an anchor pivoted at a pivot position on the lever arm adjacent the rim engaging means, the anchor having a top member adapted for engagement with the peripheral rib on the container wall, and a bottom stabilizing member adapted to rest against the container wall below the peripheral rib, such that when the tool is engaged with a container, the rim engaging means positioned under the overlapping rim of the lid, and the top member of the anchor engaging the peripheral rib of the container wall, lever action of the tool raises the lid from the container.

DRAWINGS OF THE INVENTION

In drawings which illustrate the embodiments of the invention:

FIG. 1 is a side view of a tool according to one embodiment of the invention positioned to open a lid from a container, FIG. 2 is an isometric side view of the tool shown in FIG. 1, FIG. 3 is an exploded isometric side view of the tool shown in FIG. 1.

DETAILED DESCRIPTION OF THE INVENTION

Figure 1:
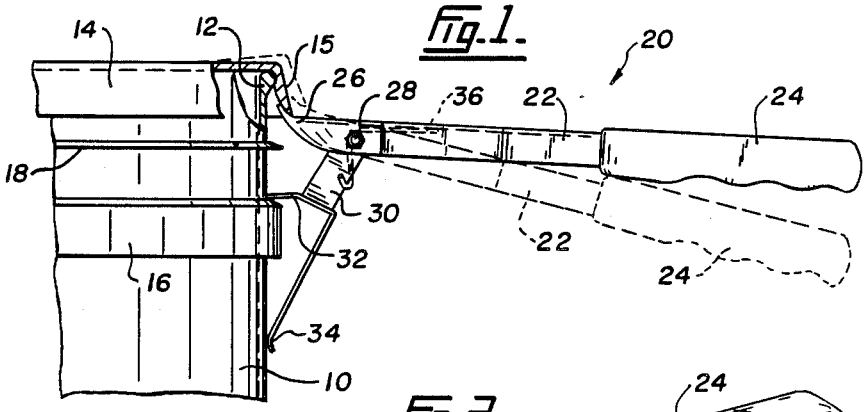

A container 10, partially shown in FIG. 1, has a cylindrical shape, generally made of a molded plastic with a lip 12 on the top edge onto which fits a lid 14 with an overlapping rim 15. The lid 14 is a snap fit onto the container 10 and has an internal groove at the top to provide a positive seal, so that when the lid 14 is on the container 10 it requires an initial force between the lid and the container to commence separation of the lid and overcome the snap fit. Peripheral ribs 16 and 18 extend around the container wall below the lid 14. The ribs 16 and 18 strengthen the side wall of the container to prevent distortion. Most containers are made of molded plastic with the ribs 16 and 18 integrally molded therein. Whereas plastic containers are referred to throughout the text, it will be understood that containers made of other materials but having the same configuration that is to say a snap on lid 14 and at least one peripheral rib below the lid 14 to reinforce the container wall, are suitable for opening with the tool of the present application.

Most of the containers are cylindrical in shape, however it is not necessary that the tool be applied always to a cylindrically shaped container, in some cases square, oval, rectangular or other configurations are applicable for opening with the tool of the present invention.

Figure 2:
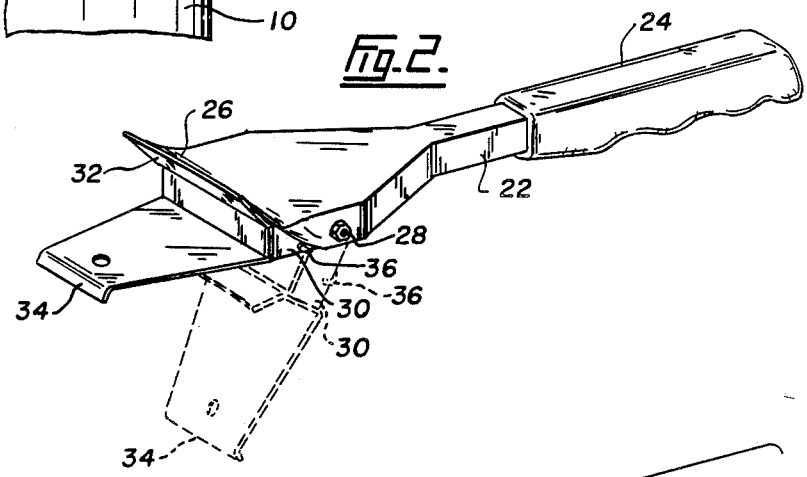
Figure 3:
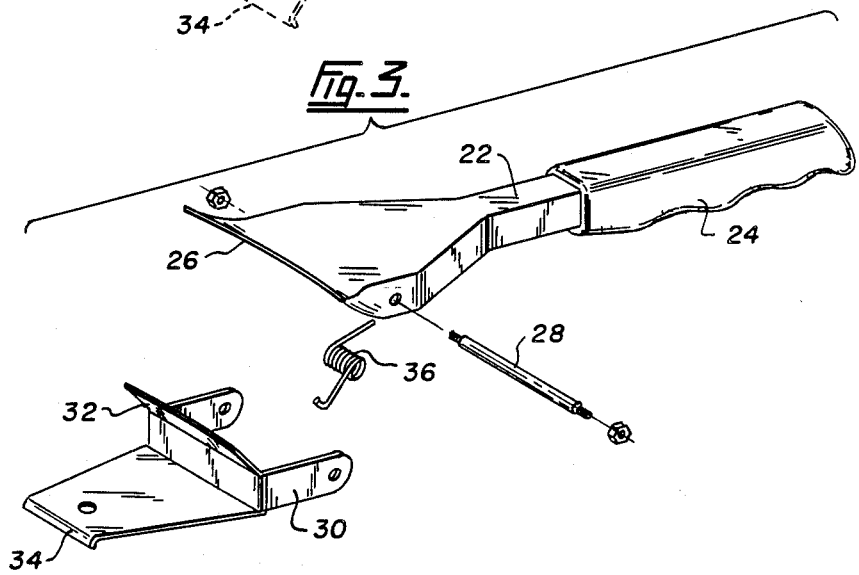

The lever 20 comprises a lever arm 22 with a handle 24 at one end and a curled lip 26 at the other end as shown in more detail in FIGS. 2 and 3. As may be seen the lever arm 22 is preferably bent from steel sheet and has a substantially U shaped cross section with a pivot and has a pin 28 through a broader portion of the lever arm 22 adjacent to the curled lip 26. The pin 28 which is fixed to the lever arm 22 by two nuts, supports an anchor 30 and provides a pivot point for the anchor to pivot relative to the lever arm 22. Whereas nuts are illustrated in the figure, rivets or other suitable fastening devices may be used. The anchor 30 has a tang 32 which is adapted to engage one of the peripheral ribs 16 and 18 of the container 10 as illustrated in FIG. 1. The distance between the curled lip 26 and the tang 32 are arranged to be such that the lever 22 is substantially horizontal when the tool 20 is placed in the correct position to open a container 10. If the lever 22 has the curled lip 26 pointing upwards then this is acceptable, however if the curled lip 26 is downwards then it is not acceptable because the lever 22 can slip out from under the rim 15 of the lid 14 when downward pressure is applied to the handle 24.

As well as the tang 32 the anchor also has a stabilizing foot 34 which rests against the cylindrical wall of the cotainer 10. This merely stabilizes the anchor 30 and assists in holding the tang 32 in place.

A coiled spring 36 is wrapped around the pivot pin 28 and provides a spring action to hold the anchor 30 substantially in line with the lever 22 when the lever is not used for opening a container 10 and also serves to hold the anchor 30 against the wall of the container 10 when the tool is in use.

When used, the curled lip 26 of the tool 20 is hooked under the rim 15 of the lid 14. The tool 20 is pushed downwards to approximately a horizontal position while keeping the curled lip 26 engaged with the rim 15 of the lid 14. The foot 34 slides down the wall of the container 10 until the tang 32 engages with one of the ribs 16 or 18. The lever handle 24 is then pushed further downwards and the pivot action about the pivot pin 28 raises the lid 14 relative to the container 10. The spring 36 insures that the anchor 30 is always pushed against the side of the container 10 and the pushing down of the handle 24 provides an upward and outward force that springs the rim away from the top lip 12 of the container 10. The user then slides the tool along to another position on the container and levers up another portion of the lid 14. This is continued until the lid is free from the container 10 and may be lifted up and removed.

Whereas one type of spring 36 is shown herein, it will be apparent that a coiled wire spring of a different type may be used or a flat leaf spring attached to the lever and pressing against the anchor may also be used. The spring 36, while not being essential aids in maintaining the anchor 30 against the container 10 and does not allow the tang 32 to slip off the peripheral rib 16 around the container wall.

Various changes may be made to the embodiments shown herein without departing from the scope of the present invention which is limited only by the following claims.

The embodiments of the present invention in which an exclusive property or privilege is claimed are defined as follows:

1. A tool for removing a lid from a container, the lid having an overlapping rim, and the container having an integral peripheral rib extending around a container wall below the lid, the tool comprising:

a lever arm having a handle at one end and a rim engaging means at the other end, an anchor pivoted at a pivot position on the lever arm adjacent the rim engaging means, the anchor having a top member adapted for engagement with the peripheral rib on the container wall, and a bottom stabilizing member adapted to rest against the container wall below the peripheral rib, such that when the tool is engaged with a container, the rim engaging means positioned under the overlapping rim of the lid, and the top member of the anchor engaging the peripheral rim of the container wall, lever action of the tool raises the lid from the container.

2. The tool according to claim 1 including spring means between the lever arm and the anchor to maintain the anchor extending out from the one end of the lever arm substantially in line with the lever arm when the tool is not engaged with a container, and to retain the anchor pressed against the container wall when the tool is engaged with a container.

3. The tool according to claim 2 wherein the spring means is a coil spring around a pivot pin at the pivot position.

4. The tool according to claim 1 wherein the rim engaging means comprises a curled lip to engage the overlapping rim of the lid.

* * * * *